United States Patent [19]

Landgraf et al.

[11] 4,046,603

[45] Sept. 6, 1977

[54] PROCESS FOR THE CONTINUOUS HARDENING OF TUBES

[75] Inventors: Helmut Landgraf, Rumeln-Kalden-hausen; Herbert Forster, Dusseldorf; Karl Meurer, Krefeld, all of Germany

[73] Assignee: Mannesmann Aktiengesellschaft, Dusseldorf, Germany

[21] Appl. No.: 592,784

[22] Filed: July 2, 1975

[30] Foreign Application Priority Data

July 5, 1974 Germany ..... 2432923

[51] Int. Cl.[2] ..... C21D 9/08

[52] U.S. Cl. ..... 148/144; 148/145; 148/150; 148/151; 148/152; 148/153

[58] Field of Search ..... 148/153, 150, 143, 144, 148/145, 151, 152

[56] References Cited

U.S. PATENT DOCUMENTS

| | | | |
|---|---|---|---|
| 2,556,236 | 6/1951 | Strickland | 148/150 |
| 3,294,599 | 12/1966 | Huseby | 148/143 |

*Primary Examiner*—R. Dean

*Attorney, Agent, or Firm*—Cullen, Settle, Sloman & Cantor

[57] ABSTRACT

The process for the continuous hardening of tubes comprises helically advancing a plurality of tubes arranged end to end in a horizontal direction and externally heating said tubes. A further step includes simultaneously or successively heating internally the said tubes and subsequently cooling said tubes both externally and internally. A further step includes temporarily accelerating the feeding of said tubes to divide the substantially continuous line of tubes into individual tubes. An additional step before externally and internally heating the tubes includes preheating said tubes to a temperature in the range of 500° to 600° C. Apparatus for the continuous hardening of tubes includes a roller table for the longitudinal helical transport of the tubes arranged end to end. An external heat source is provided for heating the tubes and an external spraying ring is arranged axially in advance of the heat source for the external cooling of the tubes. An internal electrical heat source internally heats the tubes and a forwardly advanced internal spraying head is provided for internally cooling said tubes successively. A tubular support is disposed axially of said tubes and mounts upon its inner end a heat source for internal heating of the tubes and internal spraying head for internal cooling of the tubes. A pair of spaced two-part clamping devices are spaced forwardly of the spraying head and displaceable transversely relative of the tube axis and adapted when opened to loosely receive said tubes. A source of electrical energy is connected to said clamps for transmitting power to the tubular support for energizing said internal heat source and internal spraying head.

12 Claims, 8 Drawing Figures

Figure 1:
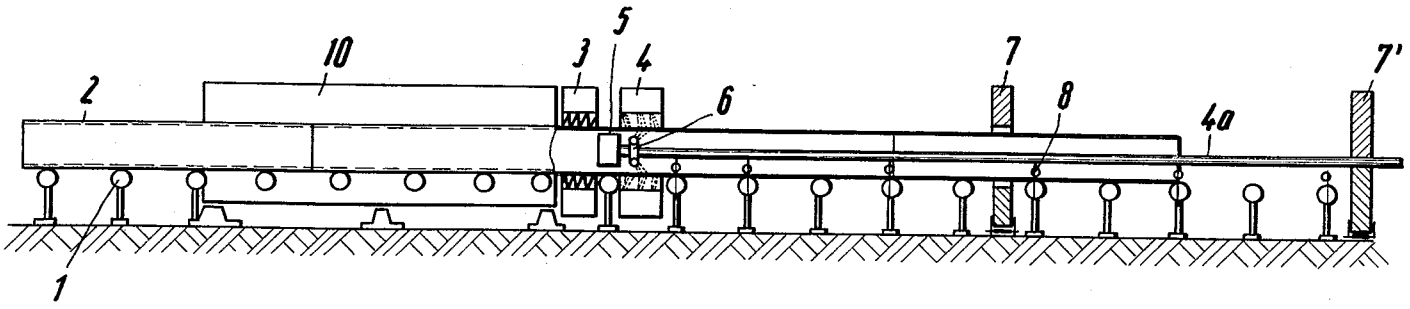

1
7
2
4a
7'
9
P

PROCESS FOR THE CONTINUOUS HARDENING OF TUBES

The invention relates to a process and an apparatus for the continuous hardening of tubes, such a thick-walled tubes made of low-alloyed steel, in a substantially horizontal position. For this purpose it is necesary to heat the tubes to austenitising level, hold them until any temperature differences over the wall thickness have been equalized, and then to cool them at a minimum speed which depends on the alloy content.

The aim of the invention is to provide a process and an apparatus which ensure increased output with continuous working, permit substantially uniform heating of the tube over it cross-section whithin a short distance, and thus obviate the risk of ovalization of the tube.

The invention provides a process for the continuous hardening of tubes, particularly thick-walled steel tubes in a horizontal position, wherein a plurality of tubes is arranged end-to-end and advanced helically while being heated externally by heating gas, flames, radiators or inductive currents, and simultaneously heated internally by radiation or electro-inductively, and subsequently cooled both externally and internally by a cooling medium, the speed of advance of the tubes being from time to time temporarily accelerated to divide the substantially continuous line of tubes into individual tubes.

The invention also provides an apparatus for carrying out the process comprising a roller table for the helical transport of the tubes, an external heat source for the external heating of the tubes, at least one external spraying ring for external cooling of the tube, an internal electrical heat source for internal heating of the tubes and an internal spraying head for internal cooling of the tubes, the internal heat source and the internal spraying head being situated within the tube and carried by a tubular support clamped at any one time in at least one to two two-part clamping devices spaced at least at a distance of more than one or two tube lengths from the internal head spraying head and being displaceable transversely relative to the tube axis, the internal spraying head being situated in a region after the external heat source, viewed in the direction of travel of the tubes, the electric energy being supplied to the internal heat source through the tubular support and energy transfer being carried out at the clamping devices.

Furthermore according to the invention it is regarded as advantageous and expedient to combine an external radiation or convection heating with an internal radiation or electroinductive heating, or an external inductive heating with an internal radiation heating.

To obtain as uniform a temperature distribution as possible for the tube wall the density of heat flow rate of the heating applied from the inside (hereinafter "internal density of heat flow rate"), is kept smaller than the density of heat flow rate of the heating applied from the outside (hereinafter "external density of heat flow rate"). With external densities of heat flow rate of up to 100 W/cm$^2$ a proportion of the internal densities of heat flow rate to the total density of heat flow rate applied to the tube of 5 to 10 % is found to be sufficient in the case of wall thickness of about 20 to 30 mm. If the density of heat flow rate is not constant during heating the mean density of heat flow rate towards the end of the heating period preceding the internal heating is to be used for calculating the internal density of heat flow rate.

For determining the duration of the internal heating ($t_h$) within the framework of the aforesaid values the following approximation formula is useful:

$$t_h = d\sqrt{q_e : q_i},$$

wherein:

$d$ = tube wall thickness in mm $q_e$ = external density of heat flow rate $q_i$ = internal density of heat flow rate.

A particularly uniform temperature distribution is obtained in the tube wall, and an additional temperature equalization section is substantially not necessary, so that an improved output can be obtained. If there are significant deviations both in the upward and in the downward directions from the given calculated time the circumstances are in fact less advantageous, but at any rate are still superior to a comparable heating from the outside only.

An apparatus according to the invention will now be described, by way of example, with reference to the accompanying diagrammatic drawings. In the drawings:

FIG. 1 shows a side view of the installation in section, and FIGS. 2 to 8 show the continuous operation of the apparatus shown in FIG. 1.

The apparatus comprises a roller table 1 for the helical transport of tubes 2 which follow one another in end-to-end contact, a preheating furnace 10, an annular or cylindrical external heat source 3 and an external spraying ring 4. Also provided in a tubular support 4a the length of which is more than double the tube lengths to be hardened, and whose forward end is held by two-part clamping devices 7, 7' which are arranged at least one tube length from one another and from the front end of the supporting tube and can be moved transversely to the direction of transport of the tube, and at least one of which is closed. An internal head, comprising an internal electrical heat source 5 and a spraying head 6, is situated in the tube 2 being hardened. The internal head 5, 6 is carried by the tubular support 4a which is supported at 8 within the tube. The internal heat source 5 is either ohmic or electro-inductive and its optimum length (1) can be calculated from the speed of advance ($v$) of the tube 2 and the heating time ($t_h$) previously mentioned using the formula $\mathbf{1} = v.t_h$.

The electrical energy for the heat source 5 and the cooling medium for the spraying head 6 are supplied through the aforesaid clamping devices 7, 7' by way of the supporting tube 4a.

Thus the apparatus allows a continuous flow of work with the rapid heating arrangement described, which gives due consideration to the material, and with simultaneous internal and external cooling.

Figures 2, 3, 4, 5, 6, 7, 8:
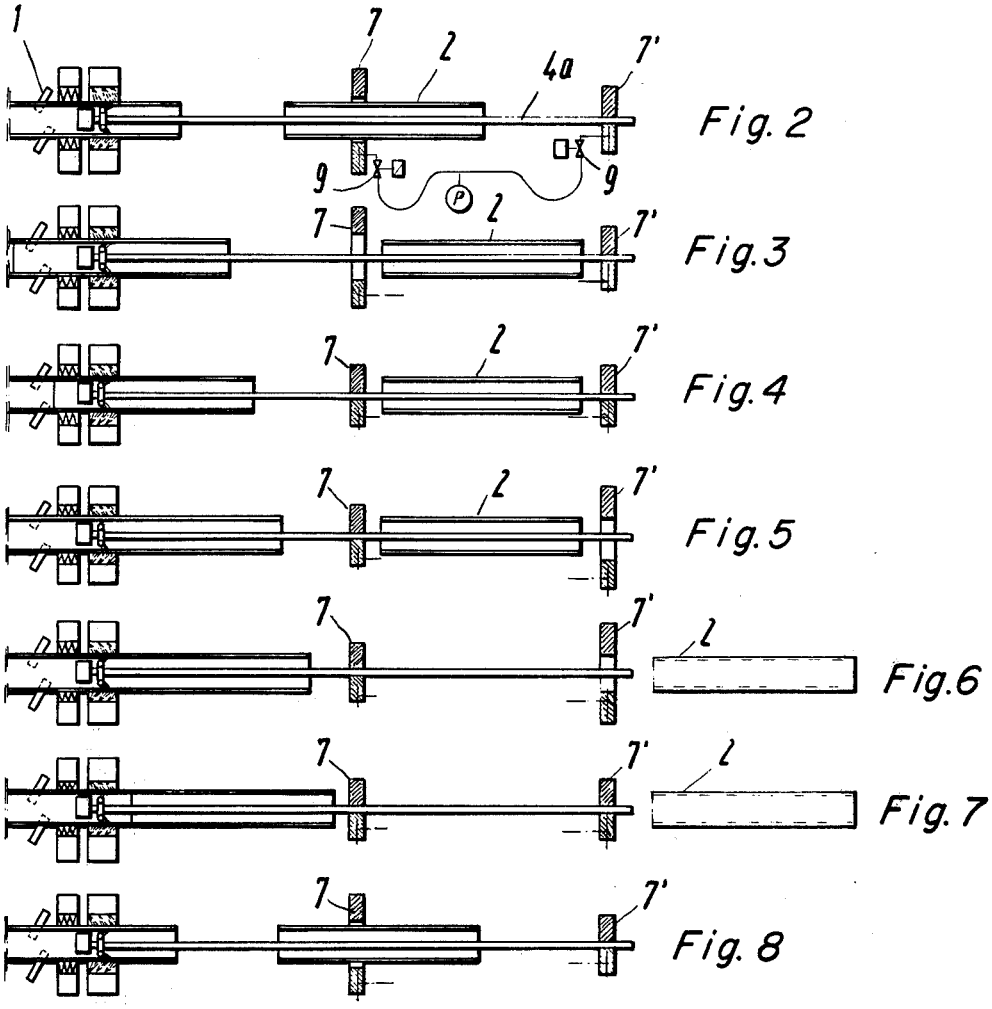

Continuous operation will be described with the help of FIGS. 2 to 8. The tube 2 which is to be hardened passes through the heating and cooling region at a constant working speed and is then accelerated (FIG. 2) through the opened first clamping device 7 up to the front of the second clamping device 7' (FIG. 3), whereupon first of all the front clamping device 7 (FIG. 4), closes and then the rear clamping device 7' opens (FIG. 5). After the tube 2 has passed through the rear clamping device 7' (FIG. 6) the said device closes (FIG. 7) and then the forward clamping device 7 is opened (FIG. 8) and is ready to receive the next hardened tube. The supply of electrical energy and cooling medium is effected periodically in parallel through the both clamping devices 7, 7′ (FIG. 4 and FIG. 7) and thus is not interrupted at any instant. For safety reasons it is advisable to transfer the electrical energy in each case by way of a contactor which is not shown here but is associated with the supporting tube 4a and which keeps the energy transfer point free of any voltage in the opened position of the clamping devices 7, 7′. Entry and exit of the cooling medium are inhibited by automatically operating electromagnetic valves 9 when the clamping device is opened.

The operation according to the present invention will be explained with the help of an example.

A tube having an external diameter of 1.20 m and a wall thickness of 45 mm is fed at a speed of 0.5 m/min and at a temperature of 500° C by a roller table with inclined driven rollers to a inductive heating stage with an effective length of 1.5 m and an effective energy flux density of 50 W/cm$^2$ with a frequency of 1000 Hz. After the external heating there is carried out an internal heating by a cylindrical radiator having a length of 0.4 m and a diameter of 1 m and an output of 2000 kW corresponding to an energy flux density of 13 W/cm$^2$. The following quenching by the spraying of water from inside and outside begins 30 seconds after the end of the heating and is spaced at a distance of 0.9 m from the nearest supporting roller of the feed device.

This gives the heating and cooling apparatus a size of 3.0 m so that it can easily be arranged in a conventional disc-type roller table.

The short-duration over-heating of about 130° C over a hardening temperature of 920° C which will be necessary for example, with this method of operation, is tolerated without any damage for example by a nickel-copper steel of approximately the following composition 0.05% C, 0.8% Ni, 1.1% Cu, 0.5% Mn, 0.3% Si.

What we claim is:

1. The process for the continuous hardening of thick-walled steel tubes, comprising the steps of:

horizontal supporting and helically advancing at a uniform speed a plurality of said tubes arranged end to end;

pre-heating said tubes to a temperature at which they still have sufficient shape-retaining ability in the range of about 500 to 600 degrees C.;

successively externally heating said tubes to an austenizing temperature by heating gas, flames, radiators, in inductive currents;

successively heating said tubes internally by radiation or electroinductively;

sucessively and simultaneously quenching said tubes externally and internally by a liquid cooling medium;

successively and temporarily accelerating the speed of advance of the tubes from time to time after hardening, dividing the substantially continuous line of tubes and longitudinally spacing the individual tubes;

and during external heating of the tubes, controlling the depth of heat penetration to less than the thickness of the tube wall.

2. In the process according to claim 1, heating each tube from the outside to a mean tube wall temperature below its required hardening temperature; and heating each tube from the inside to a means tube wall temperature corresponding to the required hardening temperature.

3. In the process of claim 2, maintaining the internal density of heat flow rate lower than the external density of heat flow rate.

4. The process as defined in claim 1, characterized by supplying cooling medium to the interior of the tubes by a horizontal tubular member to perform the internal quenching; and supporting the tubular member in the horizontal position by alternately operable gripping means which include radially movable gripping members to accomodate displacement of the tubes after the quenching step.

5. A process according to claim 1, wherein the external heating is carried out with constant density of heat flow rate.

6. A process according to claim 1, wherein the external heating is carried out with a variable density of heat flow rate, which at least temporarily is higher than 50 W/cm$^2$.

7. A process according to claim 2, wherein the external and internal heating zones overlap one another.

8. A process according to claim 2, wherein when the tube is externally heated by radiation or convection the internal density of heat flow rate amounts to between about ½ to ¼ of the external density of heat flow rate.

9. A process according to claim 2, wherein, when the tube is heated from the outside inductivelt a frequency of 500 to 1000 Hz is used and the internal density of heat flow rate amounts to between about ¼ and ⅛ of the external density of heat flow rate.

10. A process according to claim 2, wherein the duration of the internal heating is so dimensioned that the proportion of the internal density of heat flow rate to the total density of heat flow rate transmitted to each tube amounts to less than 20%.

11. A process according to claim 10, wherein the proportion amounts to 3 to 8 %.

12. A process according to claim 2 wherein the heating and cooling of the tubes are carried out for a brief duration separately from one another for temperature equalisation in the tube wall.

* * * * *